US011479430B2

(12) United States Patent
Shimba et al.

(10) Patent No.: US 11,479,430 B2
(45) Date of Patent: Oct. 25, 2022

(54) CONTACT ROLLER

(71) Applicants: Kobayashi Engineering Works, Ltd., Shizuoka (JP); Kinyosha Co., Ltd., Tokyo (JP)

(72) Inventors: Yasuhito Shimba, Fuji (JP); Satoshi Nishioka, Tokyo (JP)

(73) Assignees: KOBAYASHI ENGINEERING WORKS, LTD., Shizuoka (JP); KINYOSHA CO., LTD., Tokyo (JP)

( * ) Notice: Subject to any disclaimer, the term of this patent is extended or adjusted under 35 U.S.C. 154(b) by 483 days.

(21) Appl. No.: 16/721,481

(22) Filed: Dec. 19, 2019

(65) Prior Publication Data

US 2020/0122947 A1 Apr. 23, 2020

Related U.S. Application Data

(63) Continuation of application No. PCT/JP2018/020616, filed on May 29, 2018.

(30) Foreign Application Priority Data

Jun. 22, 2017 (JP) ..... JP2017-122370

(51) Int. Cl.
*B65H 23/025* (2006.01)
*B65H 18/26* (2006.01)

(52) U.S. Cl.
CPC ..... *B65H 23/0256* (2013.01); *B65H 18/26* (2013.01)

(58) Field of Classification Search
CPC ..... B65H 23/0256; B65H 18/26; B65H 27/00
See application file for complete search history.

(56) References Cited

U.S. PATENT DOCUMENTS 5,129,876 A 7/1992 Brabant et al.

FOREIGN PATENT DOCUMENTS

| | | |
|---|---|---|
| CN | 202807996 | 3/2013 |
| JP | S60112563 | 6/1985 |
| JP | H0258927 | 4/1990 |
| JP | H0466462 | 3/1992 |
| JP | H05124761 | 5/1993 |
| JP | H0616301 | 1/1994 |
| JP | 2003040503 | 2/2003 |
| JP | 3155292 | 11/2009 |
| JP | 2014109293 | 6/2014 |

OTHER PUBLICATIONS

International Search Report for International Application PCT/JP2018/020616, dated Aug. 21, 2018.
Office Action Issued in Corresponding CN Application No. 201880053874.X, dated Nov. 16, 2020.

*Primary Examiner* — William E Dondero
(74) *Attorney, Agent, or Firm* — Burris Law, PLLC

(57) ABSTRACT

A contact roller according to one embodiment includes a cylindrical rubber roll main body, two spiral groove groups provided in a surface of the rubber roll main body, spiral rubber layers which is provided in the groove groups and hardness of which is lower than the rubber roll main body, and a surface rubber layer which covers a surface of the rubber roll main body and hardness of which is lower than that of the rubber roll main body. Nip pressure of the surface rubber layer corresponding to the rubber roll main body is higher than that of the surface rubber layer corresponding to the spiral rubber layers.

1 Claim, 3 Drawing Sheets

CONTACT ROLLER

CROSS-REFERENCE TO RELATED APPLICATIONS

This application is a continuation of International Application No. PCT/JP2018/020616, filed on May 29, 2018, which claims priority to and the benefit of Japanese Patent Application No. 2017-122370, filed on Jun. 22, 2017. The disclosures of the above applications are incorporated herein by reference.

FIELD

The present disclosure relates to a contact roller.

BACKGROUND

In sites of manufacturing paper- or plastic-made films, the manufactured film are finally rolled around take-up rolls, and then stored in the form of rolled goods. When rolling a film around a take-up roll, wrinkles may be created on the film, and air is taken in between the rolled-around film layers, thus forming air layers. In order to prevent wrinkles on a rolled film, or air layers between film layers, a contact roller is used to press the film on the take-up roll. However, with merely pressing a film on a take-up roll by a contact roller, it is still not possible to fully prevent the creation of wrinkles and the formation of air layers.

Under these circumferences, Patent Literature 1 (JP 2014-109293 A) discloses a rubber roll (contact roller) comprising a cylindrical main body of the rubber roll, spiral grooves which is formed in a surface of the rubber roll main body and turn along reverse directions to each other with respect to a longitudinal center of the rubber roll main body, and rubber layers (spiral rubber layers) filled in the grooves so as to be flush with the surface of the rubber roll main body, and whose hardness is lower than that of the rubber roll main body. The spiral rubber layers filled in the grooves have hardness lower than that of the rubber roll main body, and have a higher coefficient of friction. Therefore, the grip force of the spiral rubber layers to the film pinched between the take-up roll and the rubber roll is higher as compared to that of the rubber roll main body. Further, the spiral rubber layers are filled respectively into the spiral grooves which turn in reverse directions to each other with respect to the longitudinal center of the rubber roll main body as a border. With this structure, due to the difference in nip pressure between the spiral rubber layers and the rubber roll main body, a tension is generated towards right and left ends of the rubber roll. Thus, when the rubber roll disclosed in the Patent Literature 1 is pressed against the take-up roll with a film sandwiched therebetween, and the film is rolled up with the take-up roll by rotating the rubber roll, for example, in the clockwise direction and the take-up roll in the counterclockwise direction, the creation of wrinkles of the film and the formation of the air layers between film layers can be prevented by the tension thus created.

SUMMARY

Recent years, there is a demand of thinning the film and improvement in the productivity of the film by high-speed rotation of the take-up roll. Under such circumstances, if the rubber roll disclosed in the Patent Literature 1 is applied to produce rolled goods, the following problem may arise. That is, if a rubber roll is pressed against a take-up roll with a film sandwiched therebetween, the film is brought into direct contact with both the rubber roll main body and the spiral rubber layers having a frictional force higher than that of the main body. Therefore, due to the difference in nip pressure (difference of frictional force) and a subtle level difference between these members, a tension fluctuation is generated on the boundary between the rubber roll main body and the spiral rubber layers. Here, if the film is thinned and the take-up roll is rotated at high speed, the influence of the tension fluctuation in the boundary between the rubber roll main body and a spiral rubber layer becomes large, which may cause a scratch or crack in the surface of the film.

An object of the embodiment is to provide a contact roller which can not only prevent wrinkles in a film and formation of air layers of between film layers, but also prevent the occurrence of a scratch or crack in the surface of the film even if the film is thinned and the take-up roll is rotated at high speed.

The contact roller according to an embodiment is used to press a film against a take-up roll when rolling the film around the take-up roll. The contact roller comprises a cylindrical rubber roll main body, two groove groups provided in a surface of the rubber roll main body, spiral rubber layers, and surface rubber layers. The two groove groups are provided spirally in the surface of the rubber roll main body, so as to be separated from each other at a longitudinal central portion thereof with a desired interval therebetween, and are arranged to turn in reverse directions to each other on both side of the longitudinal central portion as a border. The spiral rubber layers are provided respectively in the two groove groups, and they have hardness lower than that of the rubber roll main body. A surface rubber layer covers the surface of the rubber roll main body including the spiral rubber layers. The surface rubber layer has hardness lower than that of the rubber roll main body. The nip pressure of a surface of the surface rubber layer, which corresponds to the rubber roll main body, is higher than the nip pressure of the surface of the surface rubber layer, which corresponds to the spiral rubber layers.

According to the embodiment, a contact roller can be provided, which can not only prevent wrinkles to be created in a film and formation of air layers of between film layers, but also prevent the occurrence of a scratch or crack in the surface of the film even if the film is thinned and the take-up roll is rotated at high speed, and further which can improve the package density of the film onto the take-up roll, the dimensional accuracy of the film along it width direction, and the quality of the film.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

Embodiments will now be described with reference to the accompanying drawings. Note that the drawings are schematic ones, in which scaling may not be exact.

Figure 1:
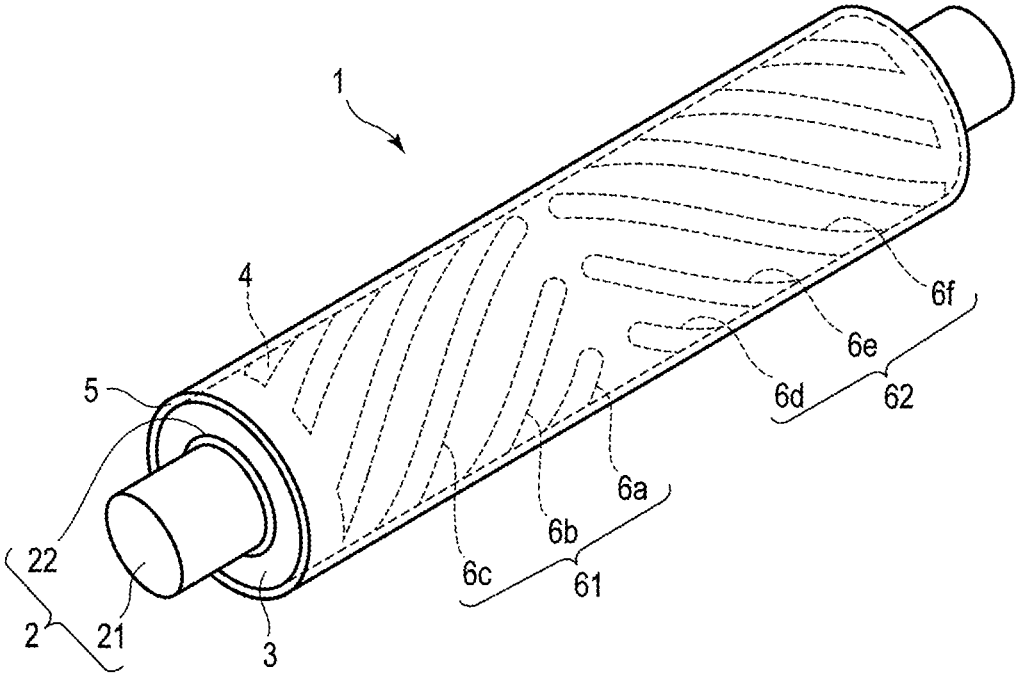
FIG. 1 is a perspective view showing an example of a contact roller according to an embodiment.

FIG. 1 is a perspective view showing an example of the contact roller according to an embodiment.

A contact roller 1 is used to press a film against a take-up roll while the film is rolled around the take-up roll.

The contact roller 1 comprises a cored bar 2, a rubber roll main body 3, the two groove groups 61 and 62, spiral rubber layers 4, and a surface rubber layer 5. The cored bar 2 comprises a rotating shaft 21 inserted to the rubber roll main body 3, and a sleeve 22 interposed between the rotating shaft 21 and the rubber roll main body 3. The sleeve 22 supports the rubber roll main body 3 and the rotating shaft 21 supports the sleeve 22 and the rubber roll main body 3, and rotates the sleeve 22 and the rubber roll main body 3. The contact roller 1 may further comprise a underlayer (not shown) between the rubber roll main body 3 and the cored bar 2. The material of the underlayer may preferably be, for example, ebonite, FRP, rubber, resin, or a combination of any of these.

The two groove groups 61 and 62, which respectively include grooves 6*a* to 6*c* and grooves 6*d* to 6*f*, are provided in the surface of the rubber roll main body 3. The two groove groups 61 and 62 are provided spirally in the surface of the rubber roll main body 3, so as to be separated from each other at a longitudinal central portion of the rubber roll main body 3 with a desired interval therebetween, and are arranged to turn in reverse directions to each other on both side of the longitudinal central portion as a border. The spiral rubber layers 4 are provided respectively in the two groove groups 61 and 62. The spiral rubber layers 4 have hardness lower than that of the rubber roll main body 3. A surface rubber layer 5 is provided to cover the surface of the rubber roll main body 3 including the spiral rubber layers 4. The surface rubber layer 5 has hardness lower than that of the rubber roll main body 3. The nip pressure of a surface of the surface rubber layer 5 corresponding to the rubber roll main body 3, that is, the surface of the part of the surface rubber layer 5 in contact with the rubber roll main body 3 is higher than the nip pressure of the surface of the surface rubber layer 5 corresponding to the spiral rubber layers 4, that is, the surface of the part of the surface rubber layer 5 in contact with the spiral rubber layers 4.

In this specification, the nip pressure is defined as a pressure applied on a contact surface between the film and the contact roller while using the contact roller of the embodiment, which is generated when the contact roller is pressed against the take-up roll with a film sandwiched therebetween. This pressure is produced by the pressure on the film by the contact roller and the repulsion force of the film to the contact roller.

Factors of the reason why the nip pressure of the surface of the surface rubber layer 5 in contact with the rubber roll main body 3 is higher than the nip pressure of the surface of the surface rubber layer 5 in contact with the spiral rubber layers 4 will be described below. The factors of the reason are: 1) the hardness of the rubber roll main body 3 is higher than the hardness of the surface rubber layer 5 and the spiral rubber layers 4; and 2) the relationship between the thickness of the spiral rubber layers 4 and the thickness of the surface rubber layer 5.

The factors 1) and 2) will be further described below.

1) The hardness of the rubber roll main body 3 being higher than the hardness of the surface rubber layer 5 and the spiral rubber layers 4

The hardness of the rubber roll main body 3 may preferably be set to such a degree that when the contact roller 1 is pressed against the take-up roll, the surface of the contact roller 1 pressed against the take-up roll is depressed by about 0.05 mm to 0.1 mm so that a desirable area of the surface of the contact roller 1 is brought into contact with the film. The upper limit of such hardness is, for example, about 1/10 of elastic modulus of iron and may preferably be less than 100° by JISA hardness. The lower limit of the hardness of the rubber roll main body 3 may preferably be 80° by JISA hardness. When the hardness of the rubber roll main body 3 is less than a JISA hardness of 80°, there is a possibility that the efficiency of pushes air outside from between film layers when rolling up by the take-up roll may be lowering.

It suffices if there is a difference between the hardness of the spiral rubber layers 4 and the rubber roll main body 3, and between the hardness of the surface rubber layer 5 and the rubber roll main body 3. When the JISA hardness is applied, the difference in hardness may preferably be, for example, 15° to 60°. If the hardness difference is less than 15°, it becomes difficult to make a sufficient difference in nip pressure between the surface of the surface rubber layer 5 corresponding to the rubber roll main body 3 and the surface of the surface rubber layer 5 corresponding to the spiral rubber layers 4. If the hardness difference exceeds 60°, there is a possibility that the difference in deformation amount by an external pressure becomes excessively large, which may cause destruction of the groove structure and shortening of the roll life.

The hardness of the spiral rubber layer 4 and that of the surface rubber layer 5 may be the same as or different from each other. When they are different, it is preferable that the hardness of the surface rubber layer 5 be higher than that of the spiral rubber layers 4.

Preferable usable materials for the rubber roll main body 3, the spiral rubber layers 4 and the surface rubber layer 5 having such hardness are, for example, rubber or resin. Examples of the rubber may be acrylonitrile-butadiene rubber (NBR), chloroprene rubber (CR), chlorosulfonated polyethylene rubber (CSM), ethylene propylene rubber (EPDM), butyl rubber (IIR), silicone rubber (Q), fluorocarbon rubber (FQM), urethane rubber (U), or a mixture of any of these. Examples of the resin may be urethane resin, epoxy resin, urea-resin, or a mixture of any of these. It suffices if the material each of the rubber roll main body 3, the spiral rubber layers 4 and the surface rubber layer 5 is selected from materials which satisfy the conditions of the hardness difference discussed above. For example, the spiral rubber layer 4 and the surface rubber layer 5 may be made from materials having the same hardness. It is preferably if the rubber roll main body 3 and the spiral rubber layers 4 are both made from chloroprene rubbers having the above-described hardness difference, because in which case, they can be adhered well to each other.

2) Relationship between the thickness of the spiral rubber layer 4 and the thickness of the surface rubber layer 5

Figure 2:
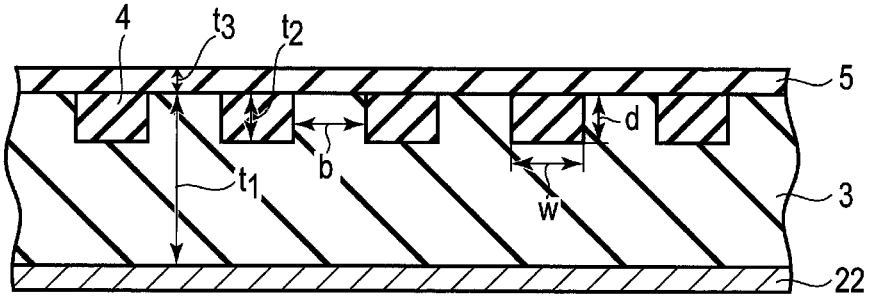
FIG. 2 is a cross sectional view briefly showing a portion of the example of the contact roller of the embodiment.

The relationship will be described with reference to FIG. 2. FIG. 2 is a cross section briefly showing a portion of the contact roller 1 when it is cut normal to the spiral rubber layers 4.

A thickness $t_2$ of the spiral rubber layers 4 may preferably be 3 mm or greater, and more preferably 4 mm or greater but 10 mm or less. If the thickness $t_2$ is less than 3 mm, it becomes difficult to make a sufficient difference in nip pressure between the surface of the surface rubber layer 5 corresponding to the rubber roll main body 3 and the surface of the surface rubber layer 5 corresponding to the spiral rubber layers 4.

A thickness $t_3$ of the surface rubber layer 5 may preferably be, for example, less than 6 mm, or more preferably, the thickness $t_3$ is 5 mm or less. It is furthermore preferable if the thickness $t_3$ is 2 mm or less. When the thickness $t_3$ of the surface rubber layer 5 is less than 6 mm, the difference in hardness between the rubber roll main body 3 and the spiral rubber layers 4 can be expressed as the nip pressure difference in the surface of the surface rubber layer 5. As the thickness $t_3$ is less, the difference in hardness between the rubber roll main body 3 and the spiral rubber layers 4 can be more prominently expressed in the surface of the surface rubber layer 5. However, when the thickness $t_3$ is less than 1 mm, there is a possibility that the surface rubber layer 5 may be damaged by wear or the like.

It is preferable that the thickness $t_3$ of the surface rubber layer 5 be less than the thickness $t_2$ of the spiral rubber layers 4.

Therefore, when the two factors described above are combined or selected properly, the nip pressure of the surface of the surface rubber layer 5 corresponding to the rubber roll main body 3 can be made into a value higher than the nip pressure of the surface of the surface rubber layer 5 in contact with the spiral rubber layer 4. As a result, the difference in nip pressure is expressed as a difference in frictional force in the surface of the surface rubber layer as will be discussed later in detail. Thus, when the contact roller 1 of the embodiment is pressed against the take-up roll with a film sandwiched therebetween, and the film is rolled around with the take-up roll, it is possible to effectively prevent the creation of wrinkles and formation of air layers between rolled film layers as will be described later.

Figure 3:
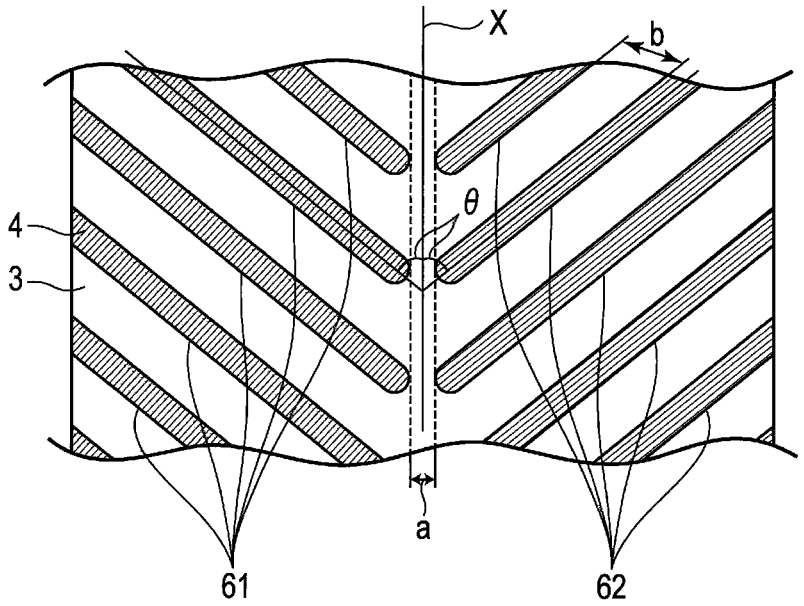
FIG. 3 is a development showing the example of a rubber roll main body and spiral rubber layers of the contact roller of the embodiment.

Each member which constitutes the contact roller 1 shown in FIG. 1 will now be described in detail using FIGS. 1 and 2, described above, and also FIG. 3. FIG. 3 is a development showing the rubber roll main body 3 and the spiral rubber layers 3 of the contact roller 1.

The cored bar 2 of the contact roller 1 shown in FIG. 1 comprises the rotating shaft 21 and the sleeve 22.

It suffices if the rotating shaft 21 is a well-known shaft used for a roll employed in a line of rolling up of a film. The rotating shaft 21 having such a structure is made from, for example, a metal or a carbon fiber composite material. An example of the carbon composite material is CFRP. In the case where the rotating shaft 21 is made from a carbon fiber composite material, the entire weight can be lightened while maintaining the strength of the contact roller 1, and it becomes simple to handle, which is preferable.

It is preferable that the sleeve be made from, for example, a metal or a carbon fiber composite material.

Note that the cored bar 2 does not necessarily comprise the sleeve 22. Or the cored bar 2 does not necessarily comprise a rotating shaft in the case where the contact roller 1 is distributed, in which the rubber roll main body 3 is supported using the sleeve 22 as a cored bar, and the rotating shaft of the sleeve is mounted by the user side, and to be used in the manufacturing site of a film.

It suffices if the rubber roll main body 3 is made to have a rubber thickness $t_1$ shown in FIG. 2, which is greater than a depth d of the grooves. The rubber thickness $t_1$ can be, for example, 5 mm to 30 mm.

The two groove groups 61 and 62 respectively including the spiral grooves **6*a* to 6*c* and the grooves 6*d* to 6*f* are provided in the surface of the rubber roll main body 3. The groove group 61 including the grooves 6*a* to 6*c* is formed from the longitudinal center to one end of the rubber roll main body 3, and the other groove group 62 including the grooves 6*d* to 6*f* is formed from the longitudinal center to the other end side. The groove group 61 and the groove group 62 may be in touch in the longitudinal center of the contact roller 1, or may be separated from each other at a desired interval a therebetween (FIG. 3). The interval a may preferably be 20 mm or less. The interval a may more preferably be 5 mm to 15 mm. When the interval a exceeds 20 mm, wrinkles or excessive air in the film contacting near the longitudinal center of the contact roller 1** may not be removed.

The grooves included in the groove group 61 and the grooves included in the groove group 62 have spiral shapes which turn in reverse directions to each other. The grooves included in the same groove group are arranged spirally and parallel to each other. A interval b between the grooves included in the same groove group (see FIGS. 2 and 3) is determined so that the contact roller 1 exhibits the desired effect of preventing wrinkles and/or the effect of pushing out air, according to the width w of the grooves, an outer diameter of the rubber roll main body 3, the hardness of the spiral rubber layer 4 and the like, which will be described later. The interval b may preferably be, for example, 5 mm to 50 mm. The interval b may more preferably be 8 mm to 20 mm.

The width w of each groove shown in FIG. 2 is determined so that the contact roller 1 exhibits the desired effect of preventing wrinkles and/or the effect of pushing out air, according to, for example, the outer diameter of the rubber roll main body 3 and the hardness of the spiral rubber layer 4 and the like. The width w of the grooves may preferably be, for example, 5 mm to 30 mm. The width w may more preferably be 8 mm to 20 mm, and even more preferably 9 mm to 20 mm.

The depth d of the grooves shown in FIG. 2 is determined according to the thickness $t_2$ of the spiral rubber layers 4. The depth d is, for example, the same as the thickness $t_2$ of the spiral rubber layers or less than the thickness $t_2$. The depth d is, for example, 3 mm or greater.

FIG. 2 shows grooves having a rectangular sectional shape, but the sectional shape of the groove may be, for example, inverted trapezoidal. When the grooves are formed into an inverted trapezoidal shape, it becomes easy to push air out of grooves when filling the grooves with the spiral rubber layers 4. Thus, the spiral rubber layers 4 and the rubber roll main body 3 can be adhered to each other well.

An angle θ shown in FIG. 3 made by the groove groups 61 and 62 and an auxiliary line x which indicates the longitudinal center of the rubber roll main body 3 may preferably be, for example, 10° to 120°. By setting the angle as such, the effect of preventing wrinkles and/or the effect of pushing out air can be further enhanced.

The number of grooves included in each groove group is not limited to the number shown in FIGS. 1 to 3, and, for example, one to twelve threads of grooves may be provided per one groove group.

The surface of the surface rubber layer 5, which corresponds to the rubber roll main body 3, may protrude from the surface of the surface rubber layer 5, which corresponds to the spiral rubber layers 4. Or conversely, the surface of the surface rubber layer 5, which corresponds to the spiral rubber layers 4, may protrude from the surface of the surface rubber layer 5, which corresponds to the rubber roll main body 3. Or regardless of arrangement of the spiral rubber layers 4, the surface of the surface rubber layer 5 may include spiral depressed and projecting portions arranged to turn in reverse directions to each other with respect to the longitudinal central portion as the border. The turning direction of the spiral depressed and projecting portions, the width, the interval therebetween, and the angle thereof may preferably be the same as those of the spiral rubber layers 4. When there are depressed and projecting portions in the surface of the surface rubber layer 5, it is preferable that the depressed and projecting portions be depressed or project by 0.02 mm to 0.05 mm from the surface of the surface rubber layer 5.

A friction coefficient μ of the surface of the surface rubber layer 5 covering the surface of the rubber roll main body 3 including the spiral rubber layers 4 may preferably be less than 0.8. When the friction coefficient μ is less than 0.5, the frictional resistance is reduced and therefore the film is not scratched. Further, the wear resistance of the surface rubber layer improves to extend the life thereof, which is more preferable. The surface of the surface rubber layer 5 which has such a coefficient of friction can be realized by setting the surface roughness Ra thereof to less than 1.0. When the surface roughness Ra is less than 0.8, the coefficient of friction becomes even lower, which is more preferable.

The rubber roll main body 3, the spiral rubber layers 4, and the surface rubber layer 5 may preferably be electroconductive. Here, the conductivity means that the surface resistance value is less than $1\times10^{13}\Omega/\square$. When the surface resistance value is in such a range, it is possible to prevent rolling error due to the film to roll around being charged. In order to make the rubber roll main body 3, the spiral rubber layers 4, and the surface rubber layer 5 conductive, it is preferable to add a conducting material, for example, carbon powder, to the rubber or resin material described above.

Figure 4:
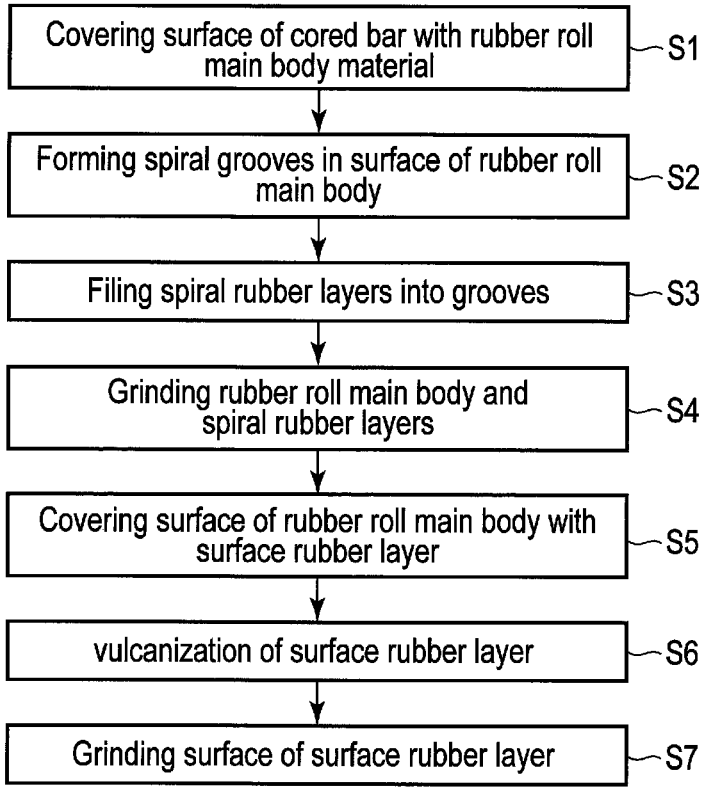
FIG. 4 is a flow chart illustrating an example of a manufacturing process of the contact roller of the embodiment.

It is preferable that the contact roller be manufactured by the following method shown in FIG. 4.

First, in step S1, the rubber roll main body is produced by covering the surface of the cored bar with the material of the rubber roll main body via an adhesive layer, followed by vulcanization. Next, in step S2, spiral grooves having a desired angle, width, and depth are formed in the surface of the rubber roll main body. In step S3, the grooves are filled with the material of the spiral rubber layers, thus forming the spiral rubber layers. In the process of S3, before the material of the spiral rubber layers is filled, an adhesive may be applied to the grooves. In the process of S4, the rubber roll main body including the spiral rubber layers is ground so as to make, for example, the surfaces of the spiral rubber layers flush with the rubber roll main body. In step S5, the surface of the rubber roll main body including the spiral rubber layers is covered with the material of the surface rubber layer. After that, in step S6, the surface rubber layer is vulcanized, and then in step S7, the surface of the surface rubber layer is ground.

By the above-discussed steps, such a contact roller can be manufactured that can prevent the creation of winkles of film, the formation of air layers between film layers, and the occurrence of scratches in the surface of the film, even if the film is thinned and the take-up roll is rotated at high speed.

The contact roller described above operates as follows.

Figure 5:
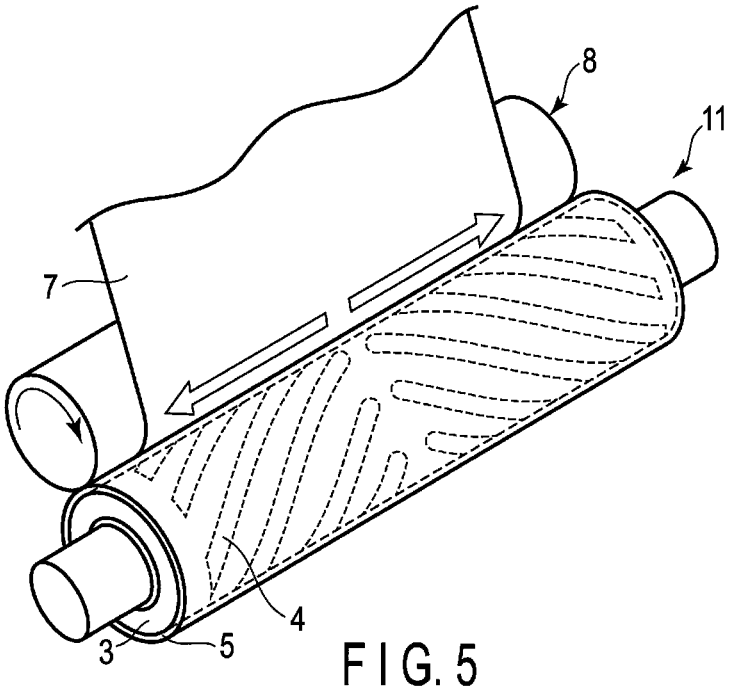
FIG. 5 is a perspective view showing an example of a situation where the contact roller of the embodiment is in operation.

FIG. 5 is a perspective view showing an example of the contact roller of the embodiment as to how it is used. The contact roller 1 is placed as it is pressed against the take-up roll 8 with the film 7 sandwiched therebetween (nipped). Examples of the film 7 are plastic films, metallic foils, paper or the like. When the contact roller 1 is rotated, for example, in the counterclockwise direction and the take-up roll 8 is rotated in the clockwise direction (as indicated by an arrow), the film 7 is rolled around by the take-up roll 8 while being pressed by the contact roller 1 against the take-up roll 8.

During this operation, a tension which stretches the film 7 in the directions of the right and left ends thereof (indicated by a hollow arrow) is generated along the movement of the spiral rubber layers 4. The tension is generated for the following reasons.

When the contact roller 1 is pushed against the take-up roll 8 with the film 7 sandwiched therebetween, the nip pressure applied to the contact surface between the surface of the surface rubber layer 5 which corresponds to the rubber roll main body 3 and the film 7 is higher than the nip pressure applied to the contact surface between the surface of the surface rubber layer 5 which corresponds to the spiral rubber layers 4 and the film 7. The frictional force applied to the contact surface is proportional to the degree of the nip pressure. As a result, the frictional force of the surface of the surface rubber layer 5 which corresponds to the rubber roll main body 3 is larger than the frictional force of the surface of the surface rubber layer 5 which corresponds to the spiral rubber layers 4.

In the surface of the contact roller 1, i.e., the surface of the surface rubber layer 5, regions where the nip pressure (frictional force) differs from one another are arranged alternately and continuously, due to the arrangement of the spiral rubber layers 4 arranged underneath. Furthermore, the spiral rubber layers 4 are formed to be spiral turning in reverse directions to each other, with respect to the longitudinal center of the contact roller 1 as the border. Therefore, if the contact roller 1 is rotated, the tension which stretches the film 7 to the right and left ends is generated.

With this tension, the creation of wrinkles in the film 7 can be suppressed. At the same time, the air sandwiched between layers of the film 7 is carried in the direction of the right and left ends and pushed out. Therefore, even in the state where the surface rubber layer 5 is applied on the surface of the rubber roll main body 3 including the spiral rubber layers 4, the effect of prevention wrinkles and the effect of pushing out air can be exhibited as in the case where the rubber roll main body 3 and the spiral rubber layers 4 are in direct contact with the film 7.

In the contact roller 1, due to the surface rubber layer being further applied onto the rubber roll main body 3 and the spiral rubber layers 4, the film 7 can be brought into contact with the surface of the smooth surface rubber layer 5, thereby making it possible to avoid the film 7 from being brought into direct contact with the surface of the rubber roll main body 3 including the spiral rubber layers 4. As a result, it is possible to prevent scratching the film 7 on the boundary of the rubber roll main body 3 and the spiral rubber layers 4, which may be caused by the difference in nip pressure and the tension fluctuation by the fine level difference on the boundary of the rubber roll main body 3 and the spiral rubber layers 4 as in Patent Literature 1 discussed in the background art. Therefore, even if the film 7 is thinned and the take-up roll 8 is rotated at high speed, a high-quality film which prevents the scratching can be rolled around the take-up roll.

As a further effect by covering the rubber roll main body 3 and the spiral rubber layers 4 by the surface rubber layer, it is possible to prevent degradation of the rubber roll main body 3 and the spiral rubber layers 4. Examples of the degradation are cracking, wearing, deformation and/or adhesion of a foreign substance, or insertion of a foreign substance between the rubber roll main body 3 and the spiral rubber layers 4. Further, by existence of the surface rubber layer 5, it is possible to prevent the pattern of the rubber roll main body 3 and the spiral rubber layers 4 from being transferred onto the film 7. Furthermore, since there are no boundary lines or level differences by structural members in the surface of the contact roller 1, the quality control including the cleaning of the contact roller 1 itself, can be conducted in a more simple way.

With these effects exhibited, according to the embodiments, a contact roller can be provided, which can not only prevent wrinkles to be created in a film and formation of air layers of between film layers, but also prevent the occurrence of a scratch or crack in the surface of the film even if the film is thinned and the take-up roll is rotated at high speed, and further which can improve the package density of the film onto the take-up roll, the dimensional accuracy of the film along it width direction, and the quality of the film.

EXAMPLE

An example in which a contact roller of the embodiments was manufactured and used will now be provided below.

A CFRP (having an outer diameter of 310 mm and a length of 8900 mm) as cored bar was covered by a special conductivity CR (having a surface resistance value of $10^6$ Ω/cm) as a rubber roll main body. The thickness of the rubber roll main body was 13 mm. The hardness of the rubber roll main body was 98 of the JISA hardness. In the surface of the rubber roll main body, twelve threads of spiral grooves each having a width of 10±0.2 mm and a depth of 5±0.2 mm were provided at intervals therebetween of 10±0.2 mm. The angle θ of turning of the spiral of the groove groups was 12.66°. The interval between two groove groups in the longitudinal center of the contact roller was 10 mm.

The groove groups were filled with the special conductivity CR (having a surface resistance value of $10^6$ Ω/cm) as the spiral rubber layers. The hardness of the spiral rubber layers was 40 to 45 of the JISA hardness. The surface of the rubber roll main body including the spiral rubber layers was covered with the special conductivity CR (having a surface resistance value of $10^6$ Ω/cm) as the surface rubber layer. The thickness of the surface rubber layer was 2±0.2 mm. The hardness of the surface rubber layer was 40 to 45 of the JISA hardness. The surface of the surface rubber layer was ground, and processed to KS treatment to have a coefficient of friction μ=0.4 and a surface roughness Ra=0.6. The outer diameter of the contact roller as the final product was 340 mm.

A plastic film (made from PET, 10 μm in thickness, and 8500 mm in width) was rolled around using the contact roller manufactured as described above. The rolling-up speed was 400 m/min. Wrinkles, scratches, or pattern transfer were not observed in the thus film.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A contact roller for pressing a film against a take-up roll when rolling the film around with the take-up roll, the contact roller comprising:

a cylindrical rubber roll main body;

two spiral groove groups provided in a surface of the rubber roll main body, so as to be separated from each other at a longitudinal center of the rubber roll main body with desired interval and turn in reverse directions to each other on both sides of the longitudinal center as a border;

spiral rubber layers provided in the two groove groups respectively and having hardness lower than the hardness of the rubber roll main body; and a surface rubber layer provided to cover a surface of the rubber roll main body including the spiral rubber layers and having hardness lower than the hardness of the rubber roll main body, wherein nip pressure of the surface of the surface rubber layer, which corresponds to the rubber roll main body, is higher than nip pressure of the surface of the surface rubber layer, which corresponds to the spiral rubber layers.

* * * * *